US006298984B1

(12) United States Patent
Weaver et al.

(10) Patent No.: US 6,298,984 B1
(45) Date of Patent: Oct. 9, 2001

(54) PACKAGING FOR DEACTIVATED CEMENT AND CEMENT ACTIVATOR AND PROCEDURE FOR MIXING DEACTIVATED CEMENT AND CEMENT ACTIVATOR THEREIN

(75) Inventors: Patrick Weaver, Glendale, AZ (US); Dag Seagren, Coral Gables, FL (US)

(73) Assignee: Einstone, Inc., Miami, FL (US)

( * ) Notice: Subject to any disclaimer, the term of this patent is extended or adjusted under 35 U.S.C. 154(b) by 0 days.

(21) Appl. No.: 09/489,425

(22) Filed: Jan. 21, 2000

Related U.S. Application Data

(60) Provisional application No. 60/116,739, filed on Jan. 22, 1999.

(51) Int. Cl.[7] ..... B65D 25/08
(52) U.S. Cl. ..... 206/222; 206/219
(58) Field of Search ..... 206/219, 221, 206/568; 215/DIG. 8

(56) References Cited

U.S. PATENT DOCUMENTS

| | | | |
|---|---|---|---|
| 408,951 | | 8/1889 | Bushnell . |
| 2,682,465 | | 6/1954 | Wiitala et al. . |
| 2,800,269 | * | 7/1957 | Smith . |
| 2,828,858 | * | 4/1958 | Tooke . |
| 2,961,365 | | 11/1960 | Sroog . |
| 2,992,768 | | 7/1961 | Gatward . |
| 3,255,872 | * | 6/1966 | Long et al. . |
| 3,330,091 | | 7/1967 | Quinn . |
| 3,366,223 | | 1/1968 | Roediger . |
| 3,809,223 | | 5/1974 | Kendall . |
| 3,860,219 | | 1/1975 | Nickerson . |
| 3,891,138 | | 6/1975 | Glas . |
| 3,913,172 | * | 10/1975 | Richards et al. . |
| 4,127,155 | * | 11/1978 | Hydorn . |
| 4,145,001 | | 3/1979 | Weyenberg . |
| 4,579,223 | | 4/1986 | Otsuka et al. . |
| 4,628,535 | | 12/1986 | Tetenborg . |
| 4,657,133 | | 4/1987 | Komatsu et al. . |
| 4,671,413 | | 6/1987 | Peterson . |
| 4,700,838 | | 10/1987 | Falciani et al. . |
| 5,370,221 | * | 12/1994 | Magnusson et al. . |
| 5,511,665 | | 4/1996 | Dressel et al. . |
| 5,549,380 | * | 8/1996 | Lidgren et al. . |
| 5,635,262 | | 6/1997 | Best et al. . |
| 5,749,202 | | 5/1998 | Eichbauer . |
| 5,770,287 | | 6/1998 | Miranda et al. . |
| 5,792,549 | | 8/1998 | Wilkie . |
| 5,804,265 | | 9/1998 | Saad et al. . |

FOREIGN PATENT DOCUMENTS 2 249 297 * 11/1990 (GB) .

* cited by examiner

*Primary Examiner*—David T. Fidei
(74) *Attorney, Agent, or Firm*—Malin, Haley & DiMaggio, P.A.

(57) ABSTRACT

A packaging having a sealed storage medium for housing deactivated wet cement product including a sealed, removably-attached separate compartment to house a chemical cement activator product, and a method of mixing each product within the packaging thereby eliminating the need for a separate mixing medium. The packaging is comprised of a waterproof, flexible plastic bag having one or more small holes with grommets into which a handle such as a looped rope can be affixed, to provide easy transport. The chemical activator with its storage compartment does not come into contact with the wet cement during storage or transport. The user may mix the contents of the chemical activator with the cement by simply opening the attached compartment housing the chemical activator, combining it with the deactivated wet cement within the compartment already housing the cement, and mixing the contents until the cement has been activated. The packaging provides a portable, combined storage and mixing system thereby eliminating the need for an additional mixing medium.

8 Claims, 2 Drawing Sheets

PACKAGING FOR DEACTIVATED CEMENT AND CEMENT ACTIVATOR AND PROCEDURE FOR MIXING DEACTIVATED CEMENT AND CEMENT ACTIVATOR THEREIN

This Application claims benefit of Provisional No. 60/116,739 filed Jan. 22, 1999.

BACKGROUND OF THE INVENTION

1. Field of the Invention

The invention relates to cement packaging and more specifically to methods of storing and mixing temporarily deactivated concrete with a chemical cement activator stored in a separate but attached storage medium.

2. Description of Related Art

Conventional concrete package mix products are sold as dry mixes. The primary ingredients of these mixes are cement, stone, and sand, which are dried prior to their insertion into a bag. For economic reasons the product is most always inserted into a paper bag, and at times a paper bag with a plastic liner. The product is then poured into a mixing device (wheelbarrow), water added, mixed, and then applied. Dry concrete package products most always are dusty, both in the store and out, and require the user to add their own water in order to mix the concrete, and require certain tools to mix.

Packaged building materials have historically been composed of paper or a combination of paper and plastic. Usage of paper in packaged building materials comprised nearly 90% of the total field by trends found in the European theater to focus on source reduction as a means of controlling waste, and advancements in the flexible plastic packaging industry have opened up otherwise closed markets to plastic-based materials.

Concrete or cement related products are typically packaged into either paper, cardboard or rigid plastic containers. The choice of paper has primarily been due to cost and the production and storage concerns. Traditional packaging methodology involves the use of valve pack paper bagging system. that blows concrete/cement related products into a paper bag.

Traditional concrete mix or cement related-package products require a moisture-free environment both during production, transportation, and storage, while certain rigid plastic containers afford some degree of moisture protection of the storage, the most prevalent being paper. Industry standards for paper bags are a three-layer construction consisting of three layers of paper and a thin moisture barrier. Holes located throughout the bags allow for pressure relief.

Flexible plastic mediums have been averted from package production of concrete/cement related items due to the inability of plastic to withstand high packaging temperatures, lack of field related polymer laminate technology and the high cost associated with such.

The concrete product is based on the concept of taking a ready-mixed concrete, the type of concrete that would come from a concrete mixer, deactivate it temporarily, and then, through the introduction of a chemical activator or some other carrier, activate it, so that it can be used just like freshly batched concrete.

Traditional, dry, powder cement must be mixed with water in a mixing device. Typically, this might be a wheelbarrow. Unused cement hardens in the wheelbarrow and ruins the wheelbarrow for other uses.

The concept of stabilizing concrete or deactivating it has been utilized in the concrete industry and the additives that have been created to do this have been patented. The same applies for the activator chemical.

Wet-Mixed Portland Cement Based Packaged Products are Portland cement based construction materials mixed in the same manner as ready mixed concrete. These mixtures incorporate a specified dosage of a hydration-stabilizing admixture to halt the water/cement chemical reaction. These mixtures are produced at a slump of 0 to 2 inches and are packaged in a flexible medium for distribution and sales. Standard cement is sold in bulk and transferred in a transit mixer. These mixers are impractical for small jobs or jobs where the large container cannot be taken directly to the site such as the basement of an already-built house.

There have been attempts in the industry to provide a storage medium comprising an attached compartment to house a product wherein the product requires separation from another product stored within the storage medium.

U.S. Pat. No. 3,860,219 issued to Nickerson, Jr. discloses a process for mixing cement and liquid wherein the bag is converted from a medium for storing the cement, into a mixing medium. Nickerson, however, fails to teach a package having two compartments, removably attached to each other, wherein each compartment houses components, separated during transport, to be mixed within one of the existing compartments.

U.S. Pat. No. 3,330,091, issued to Quin, discloses a disposable box for on-site mixing of dry cement. The box does not contain all of the ingredients and the product cannot be shipped therein.

U.S. Pat. No. 5,804,265, issued to Saad et al, discloses a bag within a bag that helps to prevent freezer burn of stored meat. Saad, however, does not contemplate storing materials between the bags, and the patent goes so far as suggesting that the outside bag should contain a hole.

U.S. Pat. No. 5,511,665, issued to Dressel et al., discloses a child-resistant package made with two layers to form an inner pocket. Dressel does not contemplate containing materials between the two layers.

U.S. Pat. No. 4,671,413, issued to Peterson, discloses pre-measured dry mix cement enclosed by a water soluble material having a water reservoir. Peterson discloses a form that contains dry cement and aids in the measurement of water to form the proper mixture. The invention is not usable at cites lacking water. Further, the invention does not disclose separating the ingredients—in fact the separator or "casing" used is dissolvable.

U.S. Pat. No. 4,657,133, issued to Komatsu et al. and U.S. Pat. No. 4,579,223, issued to Otsuka et al., disclose packages that selectively allow ambient air into the packages.

U.S. Pat. No. 3,366,233, issued to Roediger, discloses a packaging for asphalt. The package discloses two layers but does not suggest storing anything between the layers.

Finally, U.S. Pat. No. 2,682,465, issued to Witala, et al., discloses a method of storing a bag within a bag having other contents. However, the inner bag is permeable.

Accordingly, what is needed in the art is a packaging apparatus which can be conveniently carried and which separately houses wet-mixed concrete and a chemical cement activator and provides a method to mix the concrete with the chemical activator in a flexible and sealable medium wherein the flexible medium is also used to store the concrete thereby eliminating the need for a separate mixing medium.

It is, therefore, to the effective resolution of the aforementioned problems and shortcomings of the prior art that the present invention is directed.

BRIEF SUMMARY OF THE INVENTION

The present invention encompasses packaging for deactivated cement and cement activator and a method of in-package mixing of deactivated cement and cement activator. For the purpose of clarity, cement and concrete are interchangeably an refer to any construction product consisting of Portland cement, mineral or chemical admixtures, sand, stone and lime.

The chemical activator would be packaged in a small flexible medium, removably attached either within or proximate the larger flexible medium. The wet mixed concrete would be packaged in a type of flexible medium that would allow the actual wet mixing to take place inside the bag, once the activator was added.

A consumer would then buy this bag of wet mixed concrete, locate the smaller bag of activator, pour its contents into the larger bag, and then massage or roll the bag for a prescribed amount of time, so as to provide a mixing affect. After mixing, the consumer would then fully open the bag and then pour out the concrete for use.

In its purchased state, the bag of wet mixed concrete already has a certain level of moisture in it, and the consumer is simply taking the additional chemical/water solution and achieving a workable mixture without ever having to use an outside water source, a mixing device, or a mixing tool. This would be of significant use to consumers in outlying areas where water supplies are scarce. Through the introduction of an advanced flexible medium, it is conceivable, as part of this invention, to deliver a package material that is substantially stronger than any other current package in the.packaged-concrete products industry, thus reducing product inventory loss. The cement, sand, and/or stone, which are the primary ingredients in a concrete mix, would all be wet.

The product conceived for storage in the package medium would be a wet concrete capable of being stabilized and then activated. The benefit of the package medium in this case is that it would allow for the product to be mixed in the package and not in the wheelbarrow thus eliminating unnecessary and messy steps associated with conventional concrete package product. Prior to use, another small package containing an activating agent would be introduced giving the concrete a "ready-mixed" freshly-batched look and feel.

Using miniature-sized mortar fractions, set-time evaluations were performed to determine if existing admixtures were available to stabilize the hydration process of Portland cement and water for a longer-term basis. Upon initial success of long-term hydration stabilization, the development of a hydration activator began. After trying a variety of existing accelerating admixtures, a new activator was developed that could successfully be used to activate the concrete and keep the physical properties of the Portland cement based products very close to those of a freshly batched mixture.

The analysis of physical properties for the activated mixtures included slump, temperature, workability, finishability, air content, unit weight, strength evaluation and set-time evaluation. The analysis of physical properties for the stabilized mixtures included slump, temperature, and stabilization duration.

Therefore, it is an object of this invention to provide a method for mixing deactivated cement and a cement activator, requiring minimal mixing when compared to dry packaged Portland cement-based products.

It is another object of the present invention to provide the user with a easy-to-transport portable packaging system for mixing cement and a cement activator which has never been available in a dry packaged product while providing increased aesthetics and purchase appeal.

It is still another object of this invention to assist in reducing project construction time.

It is still yet another object of this invention to provide a flexible package with improved barrier properties which provide longer storage life and less package loss during shipping and on shelves.

It is still another object of the present invention to provide a storage and mixing system which can safely store its contents in an open-air environment during certain times of the year (ambient temperatures between 50 and 90 degrees F.)

It is still another object of the present invention to provide easy-to-follow instructions printed on the bag and to provide ease of handling with a rope handle all on a product which can be easily disposed of in the resealable bags.

It is still another object of the present invention to provide an environmentally and health-friendly product by eliminating PM10 type dust, and, since the Portland cement is encapsulated by water at batch time, eliminate the consumer's exposure to these harmful particulates.

In accordance with these and other objects which will become apparent hereinafter, the instant invention will now be described with particular reference to the accompanying drawings.

DETAILED DESCRIPTION OF THE INVENTION

The present invention will now be described in detail utilizing one embodiment for example.

Figure 1:
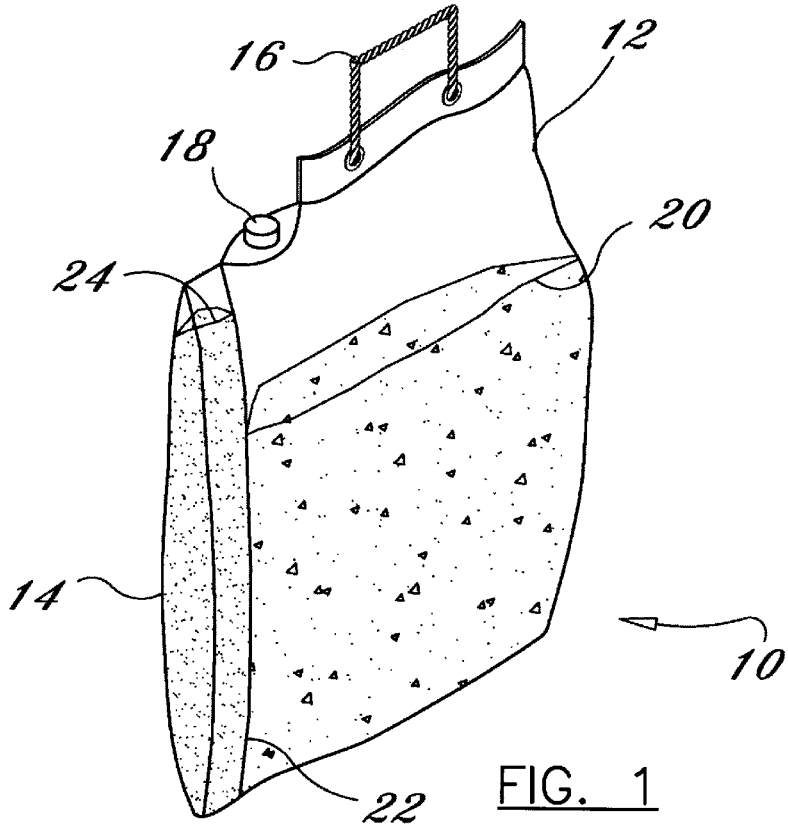
FIG. 1 shows a perspective view of the preferred embodiment of the present invention.

FIG. 1 shows package 10 having a large storage section 12, an attached smaller storage section 14, a rope handle 16 and a screw fitment 18. Package 10 is a flexible bag made of waterproof plastic and is designed to hold approximately forty pounds of wet cement 20. The cement is purchased in this bag and resides in large storage section 12.

Figure 4:
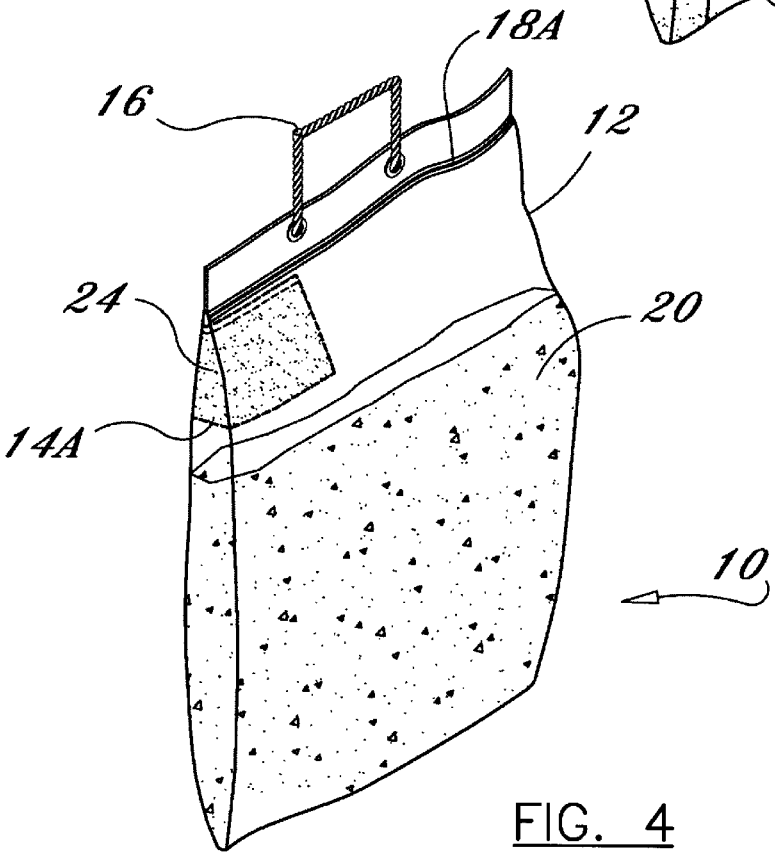
FIG. 4 shows a perspective view of an alternate embodiment of the present invention having an inner smaller pouch 14A.

In the preferred embodiment, smaller storage section 14 is removably attached to larger storage section 12 via a perforated seal 22. Seal 22 is shown in FIG. 1 running along the longitudinal vertical edge of package 10 and more specifically, along the interface of the edges of larger storage section 12 and smaller storage section 14. However, in other embodiments, smaller storage section 14 can be attached virtually anywhere on or within package 10. FIG. 4 shows an alternate embodiment where the smaller storage area is a small pouch, located within larger storage section 12.

Package 10 is a strong, water proof plastic bag. The bag may comprise a series of different polymer layers. In the preferred embodiment of the present invention, the bag comprises the following layers: PET, LDPE, PE and polyester, and Metalicine.

Figure 2:
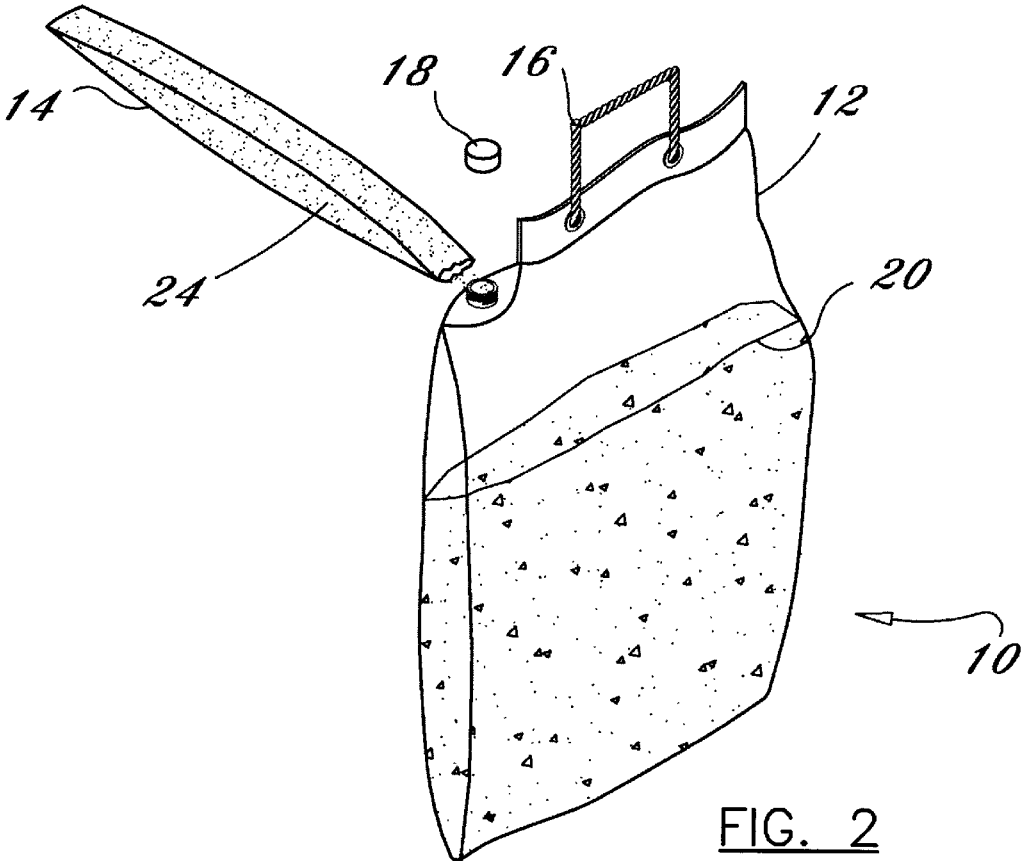
FIG. 2 shows a perspective view of the preferred embodiment with smaller pouch 14 detached.

A user may access a chemical cement activator 24 stored within smaller storage section 14 by tearing along the perforated seal 22. FIG. 2 shows smaller storage section 14 removed from larger section 12. The user may then unscrew fitment 18 which allows access to the cement 20 within larger storage section 12, and pour in activator 24. The mixing of chemical activator 24 and cement 20 takes place within larger storage section 12 of package 10. No other temporary or permanent storage medium is needed.

In the preferred embodiment, the type of stabilizer used are the type sold by Master Builders and W. R. Grace under the tradename DELVO® and RECOVER®.

Figure 3:
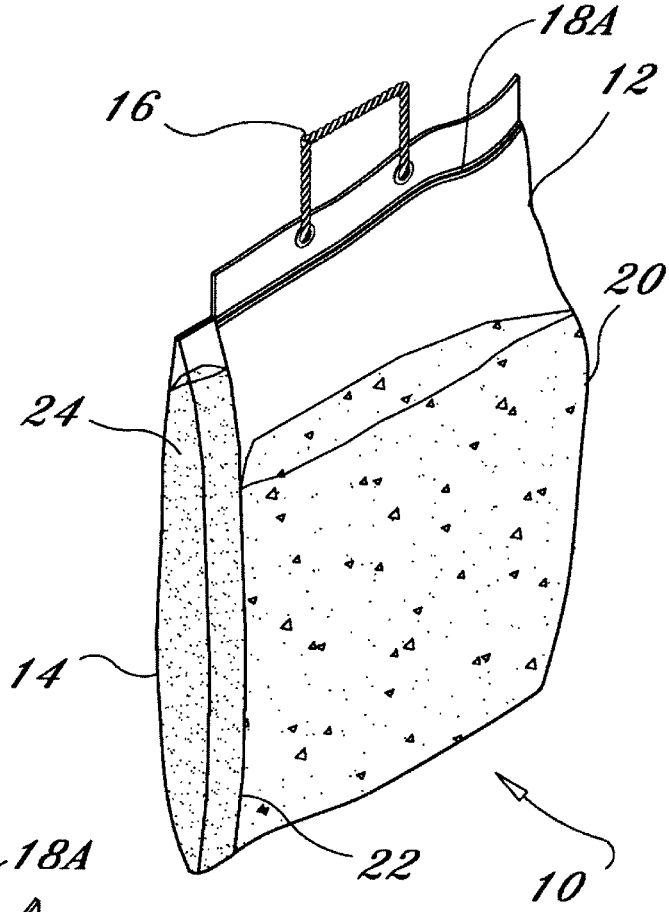
FIG. 3 shows a perspective view of an alternate embodiment of the present invention.

In FIG. 3, one end of package 10 is shown to be closed using a reinforced header seal 18A. Zip lock seals may also be used to ensure proper closure of the package. One or more grommets can be inserted within small apertures within this seal. Handle 16, in the form of a rope of other appropriate handle device can be attached through the grommets. A rope loop handle will not break under the weight of the cement in the bag as prior art plastic handles may when sewn onto paper bags of dry cement.

A plurality of zip locks may be added to the opening of the package to strengthen the closure. The closure must be strong enough to support the contents of the package, usually forty pounds of wet cement.

FIG. 4 shows package 10 in an alternate embodiment. Activator 24 resides within smaller pouch 14A which is removably attached anywhere within the interior of large storage section 12. Here, large section 12 is opened to reveal smaller pouch 14A therein. Pouch 14A is detached, its contents emptied into large section 12 to be combined with cement 20 therein.

Upon purchase and use, the consumer activates the product with the attached additive accompanied by a prescribed amount of mixing. After activating the mixture, the consumer will have a construction material with the same properties as if it were freshly batched.

Wet-Mixed Portland Cement Based Packaged Products are produced in the same manner as ready mixed concrete. After the specified mixture is batched and mixed, the product is discharged into the bagging plant and bagged per the specified size using standard bag plant procedures. The bags are then palletized and stored for delivery (50–90 degrees F. storage temperature).

When the consumer is ready to begin the construction process utilizing Wet-Mixed Portland Cement Based Packaged Products the following instructions will be provided.

Open bag and add activator to the mixture.

Re-seal bag and mix for a minimum of 2 minutes.

Product is now ready for use.

This mixture must be used within 60 minutes of adding activator.

Other useful information can be provided to help the consumer achieve the desired results.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A package for retaining and mixing deactivated cement and separately-stored cement activator comprising:

a first flexible sealable storage medium;

wet mixed deactivated concrete situated within said first flexible storage medium;

a second sealable flexible storage medium removably attached to said first flexible storage medium, wherein each said storage medium may be detached from the other without rupture of said storage medium, and the contents of said detached storage medium safely transported to another location;

chemical cement activator stored within said second medium wherein said activator is stored separately from said concrete; and carrying means for transporting said package.

2. The package of claim 1 wherein said carrying means is a rope threaded through one or more openings situated near the edge of said package thereby forming a handle.

3. The package of claim 1 wherein said first flexible storage medium is a waterproof plastic bag.

4. A package for retaining and mixing deactivated cement and a separately-stored product comprising:

a first flexible sealable storage medium;

wet mixed concrete situated within said first flexible storage medium;

a second sealable flexible storage medium removably attached to said first flexible storage medium wherein said second flexible storage medium houses a product to be mixed with said wet mixture concrete;

each said storage medium may be detached from the other without rupture of said storage medium, and the contents of said detached storage medium safely transported to another location; and carrying means for transporting said package.

5. The package of claim 4, wherein said second storage medium is housed within said first storage medium.

6. The package of claim 1 wherein said second storage medium is removably attached to said first storage medium via a perforated attachment.

7. The package of claim 4 wherein said second storage medium is removably attached to said first storage medium via a perforated attachment.

8. A package for retaining and mixing deactivated cement and separately-stored cement activator comprising:

a water-impervious first flexible sealable storage medium;

wet mixed deactivated concrete situated within said first flexible storage medium;

a second sealable flexible storage medium removably attached to said first flexible storage medium via perforated attachment means, wherein each said storage medium may be detached from the other without rupture and the contents of said detached storage medium safely transported to another location;

chemical cement activator stored within said second medium wherein said activator is stored separately from said concrete; and a rope threaded through one or more openings situated near the edge of said package thereby forming a handle for transporting said package.

* * * * *